US005517087A

United States Patent [19]

Miyashita

[11] Patent Number: 5,517,087

[45] Date of Patent: May 14, 1996

[54] FLUORESCENT LAMP IGNITION CIRCUIT

[75] Inventor: Kazuhiro Miyashita, Fukiage, Japan

[73] Assignee: Jetta Computer Co., Ltd., Taipei Hsien, Taiwan

[21] Appl. No.: 525,017

[22] Filed: Sep. 8, 1995

[51] Int. Cl.[6] ..... H05B 41/16

[52] U.S. Cl. ..... 315/257; 315/200 R; 315/209 T; 315/209 SC; 315/306; 315/310; 315/DIG. 5

[58] Field of Search ..... 315/200 R, 207, 315/209 T, 209 CD, 209 SC, 224, 266, 276, 278, 289, 306, 310, 287, 354, DIG. 2, DIG. 5, DIG. 7, 222, 257

[56] References Cited

U.S. PATENT DOCUMENTS

| | | | |
|---|---|---|---|
| 4,061,899 | 12/1977 | Gillitzer et al. | 315/222 X |
| 4,277,728 | 7/1981 | Stevens | 315/307 |
| 4,320,325 | 3/1982 | Anderson | 315/278 X |
| 4,523,131 | 6/1985 | Zansky | 315/307 |
| 4,723,098 | 2/1988 | Grubbs | 315/DIG. 7 X |
| 4,933,605 | 6/1990 | Quazi et al. | 315/DIG. 2 X |
| 5,142,202 | 8/1992 | Sun et al. | 315/225 |
| 5,173,643 | 12/1992 | Sullivan et al. | 315/257 X |

*Primary Examiner*—Robert Pascal
*Assistant Examiner*—Haissa Philogene
*Attorney, Agent, or Firm*—Bacon & Thomas

[57] ABSTRACT

A fluorescent lamp ignition circuit of the type including a DC voltage stabilizer to process input voltage into a constant voltage by dropping or boosting, an inductance filter to receive output power supply from the DC voltage stabilizer and to remove surge from it, an oscillator having a transformer, which receives output power supply from the inductance filter and then provides a sin-wave output for igniting a fluorescent lamp, and a feedback circuit connected between the oscillator and the fluorescent lamp to provide a feedback signal to the DC voltage stabilizer, wherein the feedback circuit includes two shunt resistors, which connect the mid-point of the secondary side of the transformer of the oscillator to earth, and two diodes respectively connected between the shunt resistors and the DC voltage stabilizer to form a double-feedback loop.

1 Claim, 6 Drawing Sheets

FLUORESCENT LAMP IGNITION CIRCUIT

BACKGROUND OF THE INVENTION

The present invention relates to fluorescent lamp ignition circuits, and relates more particularly to such a fluorescent lamp ignition circuit which comprises a double-feedback loop that reduces the voltage of the circuit to earth to one half of the input voltage so as to minimize power loss.

FIG. 1 shows a fluorescent lamp ignition circuit according to the prior art. This fluorescent lamp ignition circuit comprises a DC voltage stabilizer 10', an inductance filter 20', an oscillator 30', and a feedback circuit 40'. The DC voltage stabilizer 10' processes 8–20 V voltage from Vin into a constant voltage by dropping or boosting, and then sends the processed constant voltage to the transformer of the oscillator 30' via the inductance filter 20'. The inductance filter 20 is to remove surge from power supply passing through and to store electric energy so as to provide the desired constant DC voltage to the oscillator 30'. The transformer of the oscillator provides a sin-wave output to the fluorescent lamp 50' by means of the oscillation induced between the inductor and the capacitor at its primary side, wherein the transistors Q1 and Q2 are for the switching between the positive half cycle and negative half cycle of the sin-wave. The feedback circuit 40' uses a resistor R to obtain output current I so as to provide a feedback voltage to the DC voltage stabilizer 10 for controlling the value of the input voltage. FIG. 2 shows the circuit of the transformer of the oscillator 30'. Because the circuit has only one end connected to earth, if the output voltage of the oscillator 30' is 375 V, the voltage of the circuit to earth is 375 V. Because the circuit is a high frequency circuit, drain current is produced, and the volume of drain current will be relatively increased when the frequency becomes higher. If to increase the brightness of the fluorescent lamp 50', the frequency must be relatively increased. However, when the frequency is increased, power loss will be relatively increased. FIG. 3 shows the relative curve between the collector current and the drain current at 31 KHz, 70 KHz, 100 KHz and 200 KHz. As indicated, when at a high frequency, much drain current is produced. Therefore, this fluorescent lamp ignition circuit cannot work properly at a high frequency level.

SUMMARY OF THE INVENTION

The present invention has been accomplished under the circumstances in view. It is an object of the present invention to provide a fluorescent lamp ignition circuit which is suitable for working at a high frequency level. It is another object of the present invention to provide a fluorescent lamp ignition circuit which greatly reduces drain current to save power supply. It is still another object of the present invention to provide a fluorescent lamp ignition circuit which greatly improves the performance of the flourescent lamp.

The aforesaid objects are achieved by improving the feedback circuit. According to the present invention, the feedback circuit comprises two shunt resistors, which connect the mid-point of the secondary side of the transformer of the oscillator to earth, and two diodes respectively connected between the shunt resistors and the DC voltage stabilizer to form a double-feedback loop.

DETAILED DESCRIPTION OF THE PREFERRED EMBODIMENT

Figure 1:
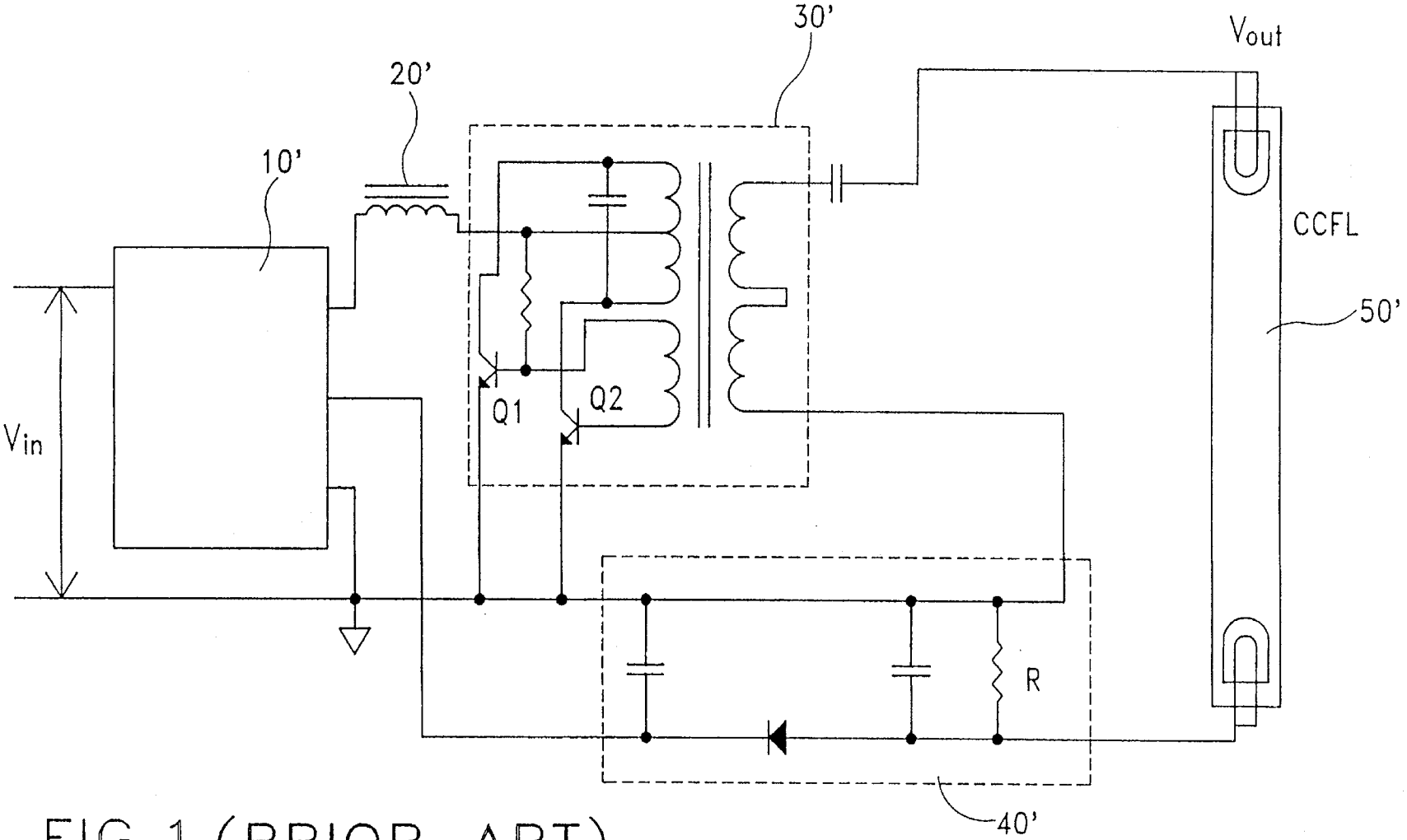
FIG. 1 (PRIOR ART)
FIG. 1 is a circuit diagram of a fluorescent lamp ignition circuit according to the prior art.
Figure 2:
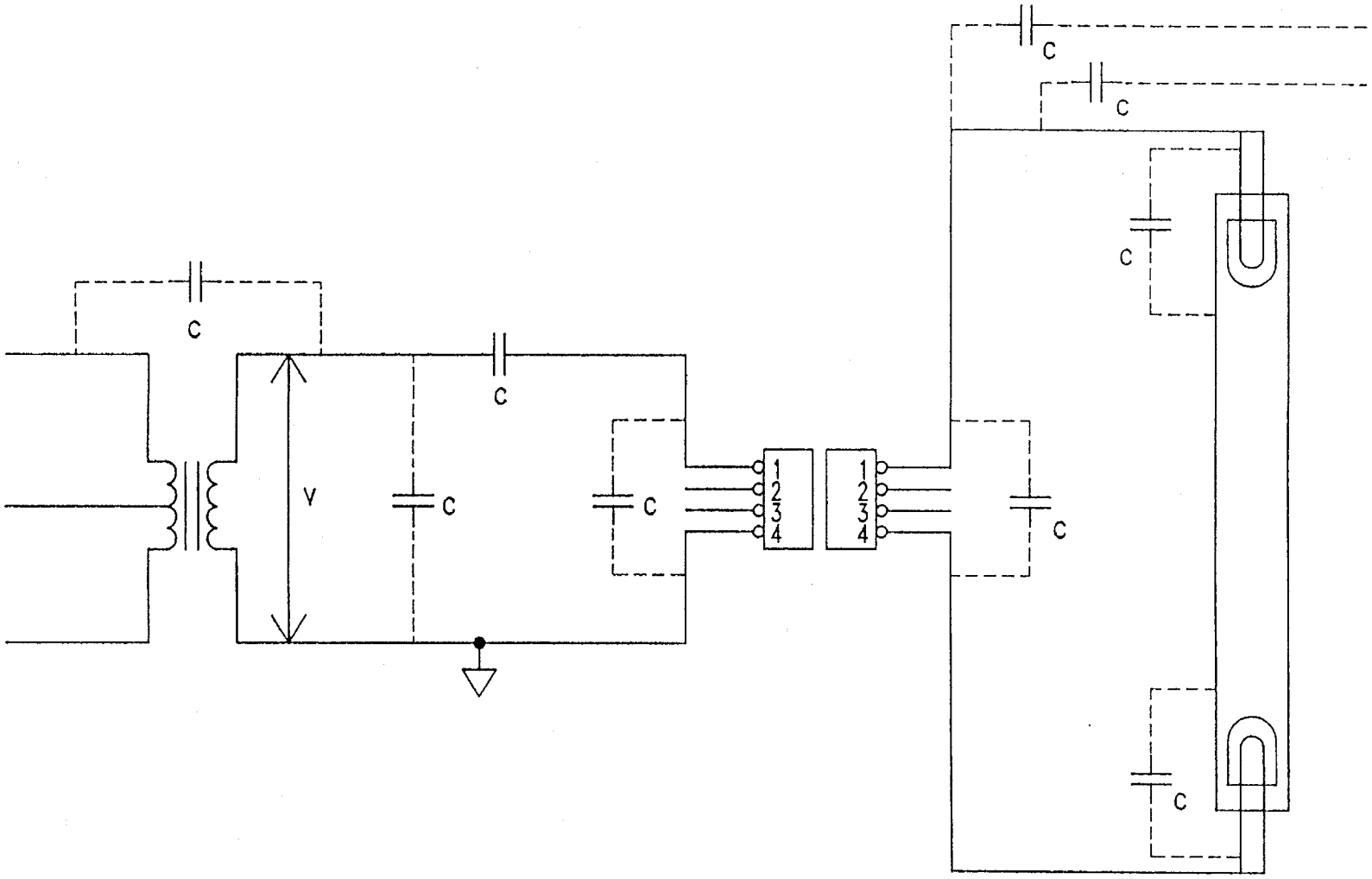
FIG. 2 (PRIOR ART)
FIG. 2 is circuit diagram of the transformer of the oscillator shown in FIG. 1.
Figure 3:
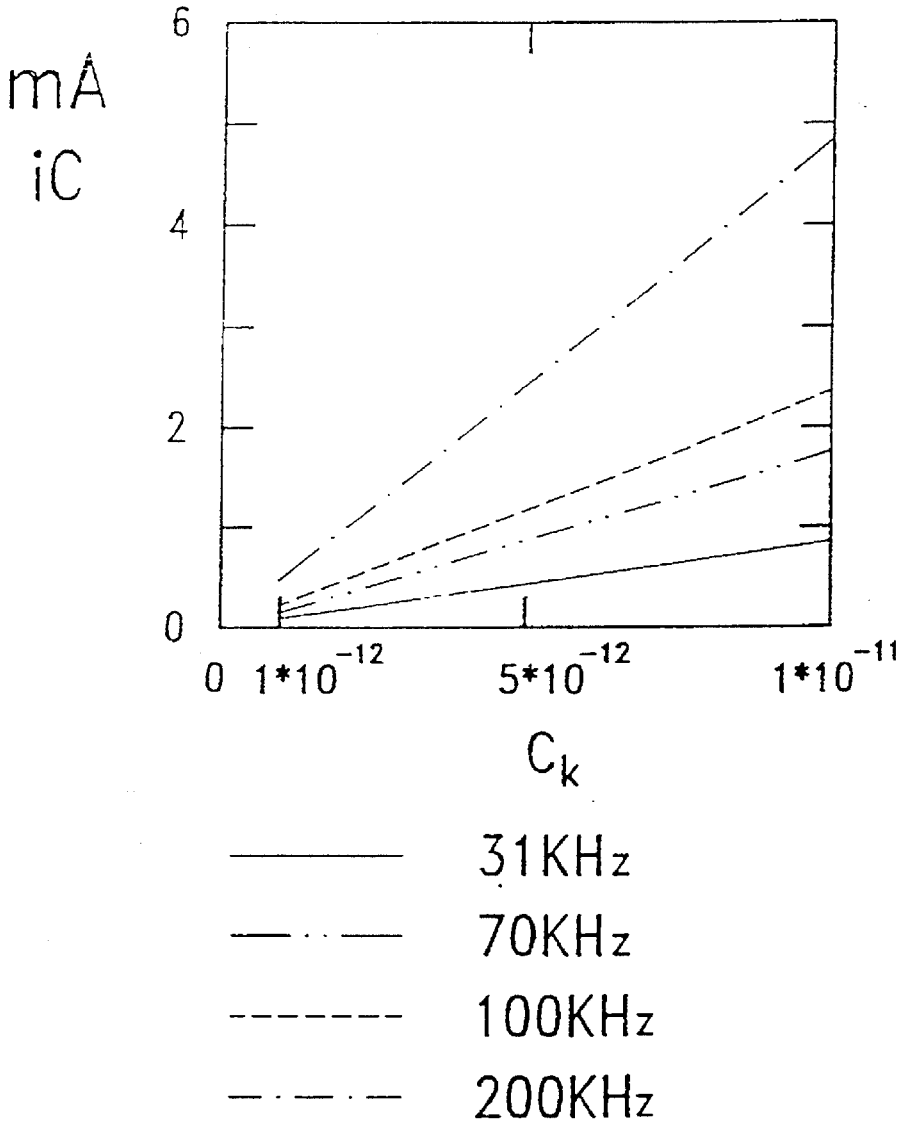
FIG.3 (PRIOR ART)
FIG. 3 shows the relative curve between the collector current and the drain current at different frequencies according to the prior art.
Figure 4:
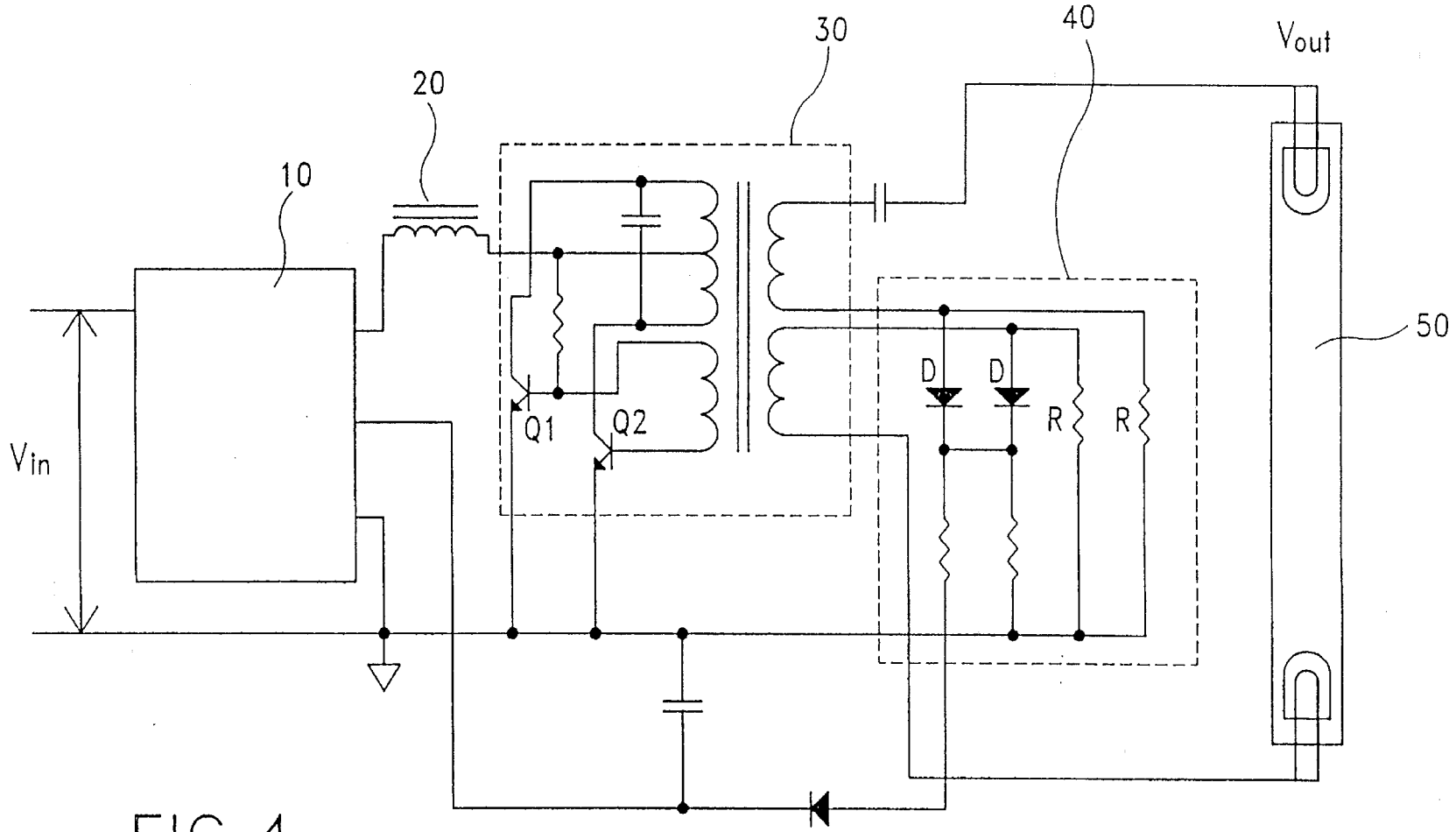
FIG. 4 is a circuit diagram of a fluorescent lamp ignition circuit according to the present invention.

Referring to FIG. 4, a fluorescent lamp ignition circuit in accordance with the present invention is generally comprised of a DC stabilizer 10, an inductance filter 20, an oscillator 30, and a feedback circuit 40. The DC voltage stabilizer 10 processes 8–20 V voltage from Vin into a constant voltage by dropping or boosting, and then sends the processed constant voltage to the transformer of the oscillator 30 via the inductance filter 20. The inductance filter 20 is to remove surge from power supply passing through and to store electric energy so as to provide the desired constant DC voltage to the oscillator 30. The transformer of the oscillator provides a sin-wave output to the fluorescent lamp 50 by means of the oscillation induced between the inductor and the capacitor at its primary side, wherein the transistors Q1 and Q2 are for the switching between the positive half cycle and negative half cycle of the sin-wave. The feedback circuit 40 comprises two shunt resistors R, which connect the mid point of the secondary side of the transformer of the oscillator 30 to earth respectively, and two diodes D respectively connected between the shunt resistors R and the DC voltage stabilizer 10 to form a double-feedback loop.

Figure 5:
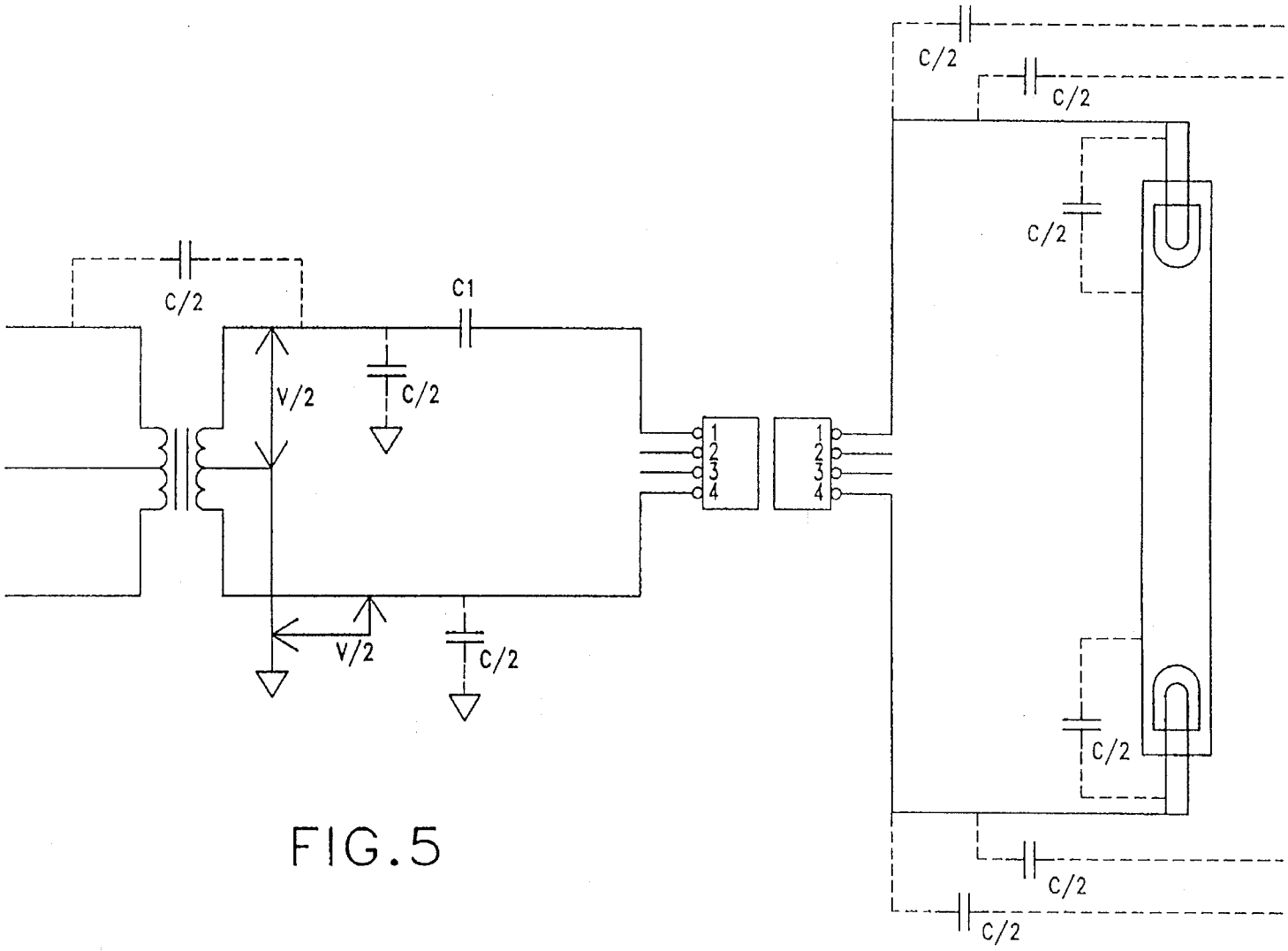
FIG. 5 is a circuit diagram of the transformer of the oscillator shown in FIG. 3.
Figure 6:
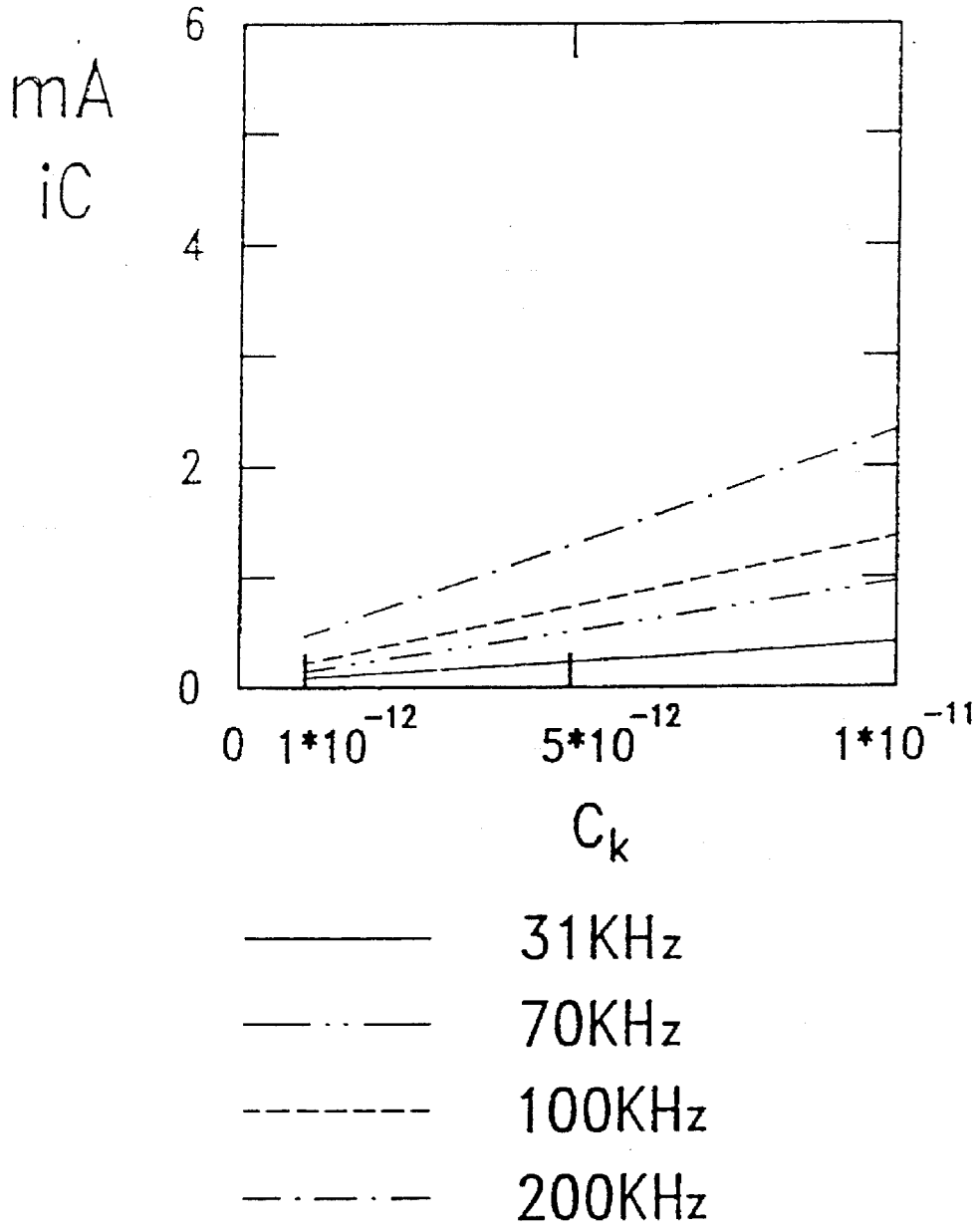
FIG. 6 shows the relative curve between the collector current and the drain current at different frequencies according to the present invention.

Referring to FIG. 5, as two shunt resistors are connected between earth and the mid point of the secondary side of the transformer of the oscillator, drain current is relatively reduced by half. Therefore, under the same output condition, the total current loss is greatly reduced in comparison with the convention ignition circuits, and the performance of the fluorescent lamp is greatly improved. FIG. 6 shows the relative curve between the collector current and the drain current at 31 KHz, 70 KHz, 100 KHz and 200 KHz. As indicated, less drain current is produced in comparison with prior art circuit when at a high frequency. Therefore, the design of the present invention permits the ignition circuit to work in a broad frequency range.

It is to be understood that the drawings are designed for purposes of illustration only, and are not intended as a definition of the limits and scope of the invention disclosed.

I claim:

1. A fluorescent lamp ignition circuit comprising a DC voltage stabilizer to process input voltage into a constant voltage by dropping or boosting, an inductance filter to receive output power supply from said DC voltage stabilizer and to remove surge from it, an oscillator having a transformer, which receives output power supply from said inductance filter and then provides a sin-wave output for igniting a fluorescent lamp, and a feedback circuit connected between said oscillator and said fluorescent lamp to provide a feedback signal to said DC voltage stabilizer, wherein said feedback circuit comprises two shunt resistors, which connect to mid-point of a secondary side of said transformer of said oscillator to earth, and two diodes respectively connected between said shunt resistors and said DC voltage stabilizer to form a double-feedback loop.

* * * * *